US006550199B2

(12) United States Patent
Phillips

(10) Patent No.: US 6,550,199 B2
(45) Date of Patent: Apr. 22, 2003

(54) PERMANENT FOUNDATION SYSTEM FOR MANUFACTURED HOUSING

(76) Inventor: Dale Phillips, 31414 Sherrie La., Magnolia, TX (US) 77354

( * ) Notice: Subject to any disclaimer, the term of this patent is extended or adjusted under 35 U.S.C. 154(b) by 0 days.

(21) Appl. No.: 09/802,065

(22) Filed: Mar. 8, 2001

(65) Prior Publication Data

US 2001/0023563 A1 Sep. 27, 2001

Related U.S. Application Data

(60) Provisional application No. 60/187,838, filed on Mar. 8, 2000.

(51) Int. Cl.[7] ..... E02D 27/00

(52) U.S. Cl. ..... 52/294; 52/299; 52/169.9; 52/741.11; 52/DIG. 11; 52/704

(58) Field of Search ..... 52/294, 298, 299, 52/169.9, 126.4, 741.11, 745.1, 745.13, DIG. 11, 704

(56) References Cited

U.S. PATENT DOCUMENTS

| | | | | | |
|---|---|---|---|---|---|
| 2,096,062 | A | * | 10/1937 | Phillips | 52/699 |
| 3,492,767 | A | * | 2/1970 | Pincus | 52/79.1 |
| 3,664,082 | A | | 5/1972 | Zintel | |
| 3,713,259 | A | | 1/1973 | Tkach | |
| 3,747,288 | A | * | 7/1973 | Grimelii | 52/23 |
| 3,751,866 | A | * | 8/1973 | Renchen | 52/149 |
| 3,830,024 | A | | 8/1974 | Warnke | |
| 3,879,905 | A | * | 4/1975 | Catalano, Sr. | 52/23 |
| 3,972,170 | A | * | 8/1976 | Brammer | 52/750 |
| 4,125,975 | A | | 11/1978 | Soble | |
| 4,528,786 | A | * | 7/1985 | Dinitz et al. | 52/98 |
| 4,738,061 | A | | 4/1988 | Herndon | |
| 4,744,182 | A | | 5/1988 | Shacket et al. | |
| 4,918,891 | A | * | 4/1990 | Gerszewski | 52/295 |
| 4,976,077 | A | | 12/1990 | Tucker | |
| 5,067,289 | A | | 11/1991 | Oderkirk et al. | |
| 5,152,108 | A | * | 10/1992 | Madl, Jr. | 52/126.1 |
| 5,870,866 | A | * | 2/1999 | Herndon | 52/169.12 |
| 6,295,784 | B1 | * | 10/2001 | Richard | 52/741.15 |

* cited by examiner

*Primary Examiner*—Carl D. Friedman
*Assistant Examiner*—Brian E. Glessner
(74) *Attorney, Agent, or Firm*—Bracewell & Patterson, L.L.P.

(57) ABSTRACT

Systems and methods for anchoring or affixing a manufactured home to the land it is located on in a permanent or substantially permanent manner. A foundation for the manufactured home is provided by excavating a plurality of parallel trenches in a spaced relation to one another. Precast longitudinal footers are disposed in the trenches. The footers include anchoring receptacles to receive a complimentary anchoring member. Soil is backfilled around the footers to partially bury them, and then the support frame of a manufactured home is secured to the footers using an anchorage assembly with an adjustable tensioner. Support blocks are disposed between the footers and the support frame to maintain the manufactured home at a desired height above the footers or the ground.

7 Claims, 4 Drawing Sheets

PERMANENT FOUNDATION SYSTEM FOR MANUFACTURED HOUSING

CROSS-REFERENCE TO RELATED APPLICATIONS

The present application claims the priority of U.S. Provisional patent application Ser. No. 60/187,838 filed Mar. 8, 2000.

BACKGROUND OF THE INVENTION

1. Field of the Invention

The invention relates to systems for providing a substantially permanent and strong foundation for manufactured housing and the like.

2. Description of the Related Art

Manufactured homes (sometimes referred to a "mobile homes") typically incorporate a support frame upon which the flooring and walls of the manufactured home are seated. The support frame normally is constructed of steel or another strong metal and has a number of steel beams or girders that run the length of the frame. The frame also often includes wheel assemblies. The manufactured home is transported to a desired location and the beams are usually supported atop concrete support blocks. As a result, the manufactured home is able to be easily moved to another location by removing the frame from the support blocks and then transporting the home atop wheel assemblies.

An arrangement such as this, which facilitates transportation of the manufactured home, is quite desirable and, in fact, provides a primary selling point for manufactured housing. Unfortunately, the mobile nature of this housing also has disadvantages. For example, because these homes are unaffixed to the land and can be easily moved thereupon, they can be pushed off their moorings by tornadoes, hurricane and other strong storms. An improved foundation system would be desirable.

SUMMARY OF THE INVENTION

The present invention provides systems and methods that permit a manufactured home to be anchored or affixed to the land it is located on in a permanent or substantially permanent manner. A foundation for the manufactured home is provided by excavating a plurality of parallel trenches in a spaced relation to one another. Precast longitudinal footers are disposed in the trenches. The footers include anchoring receptacles that receive a complimentary anchoring member. Soil is backfilled around the footers to partially bury them. The support frame for a manufactured home is then secured to the footers using an anchorage assembly with an adjustable tensioner. Support blocks are disposed between the footers and the support frame to maintain the manufactured home at a desired height above the footers or the ground.

DETAILED DESCRIPTION OF THE PREFERRED EMBODIMENTS

Figure 1:
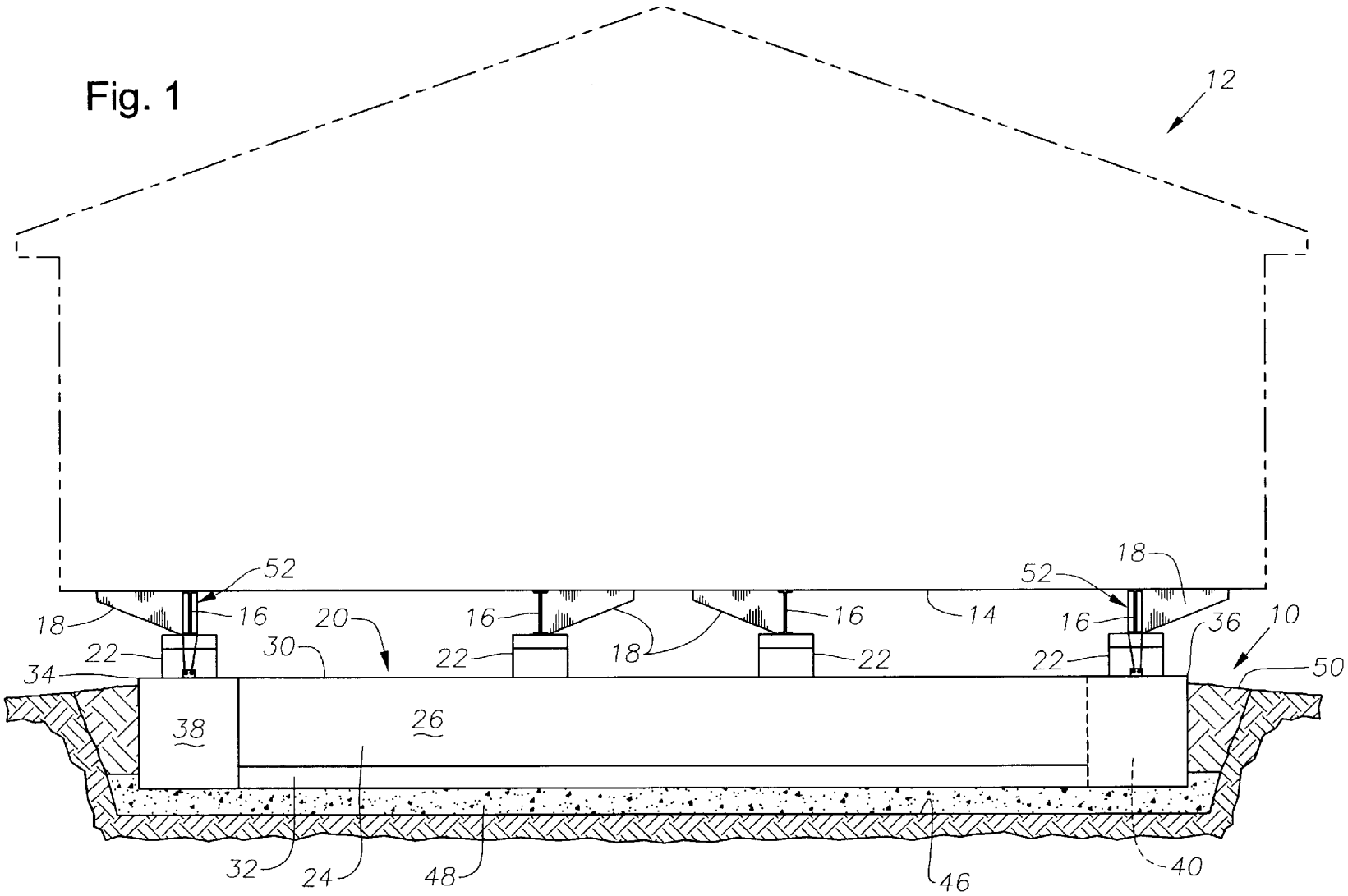
FIG. 1 is a side view of a manufactured home site.
Figure 2:
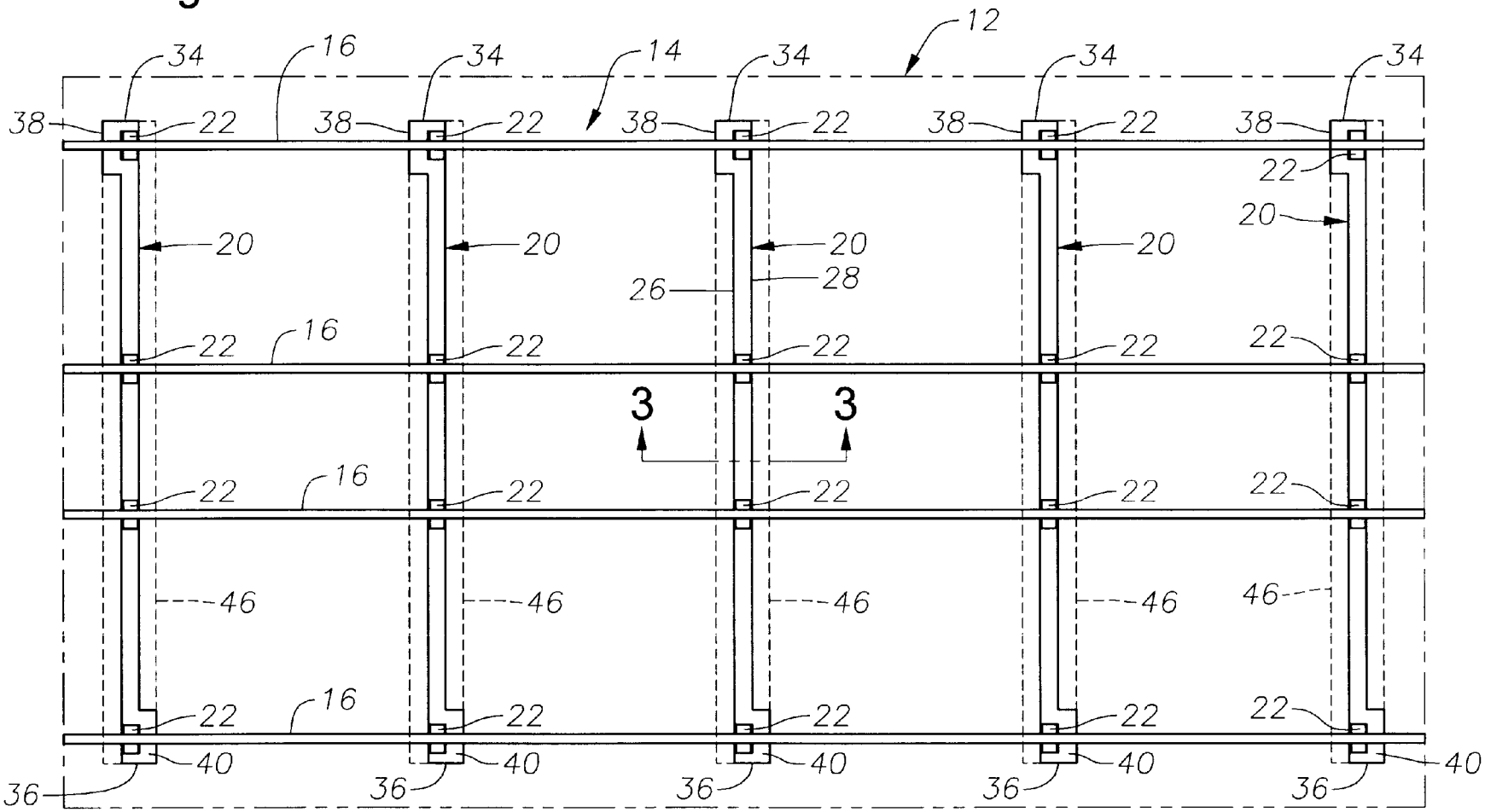
FIG. 2 is a plan view of the site shown in FIG. 1.

Referring first to FIGS. 1 and 2, there is shown an area of land 10 that is being employed as a location or site for a manufactured home 12. As will be described, the home 12 has been anchored to a foundation in the land so that the home is substantially permanently affixed to the land 10.

The manufactured home 12 includes a substantially rectangular support frame 14 that has a plurality of longitudinal girders 16 of I-beam shape. Flanges 18 adjoin the web of the girders 16 at intervals to add strength to the frame 14. The upper portions of the home 12 are shown in phantom in FIG. 1, the details of it being well known in the art and capable of numerous variations in construction.

The area of land 10 has a plurality of longitudinal footers 20 buried therein. It is noted that the footers 20 are disposed perpendicular to the girders 16. Support blocks 22 are placed atop the footers 20, and the girders 16 are seated thereupon. The support blocks 22 are of suitable size and height to support the girders 16 at a desired height above the land 10.

Figure 3:
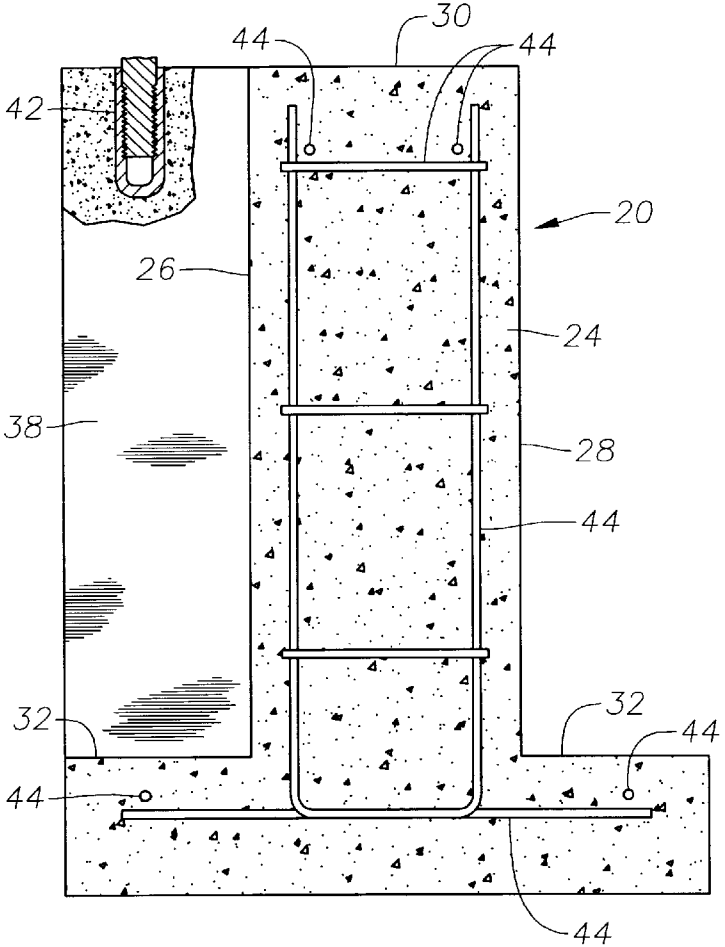
FIG. 3 is a side cross-sectional view of an exemplary precast footer.

FIG. 3 illustrates, in cross section, an exemplary foundation footer 20 which has a length that approximates the width of the manufactured home 12. The majority of the length of the footer 20 presents a 'T-shaped' cross-section wherein there is a narrow, vertically-disposed upper portion 24 that presents first and second side walls 26,28. The upper portion 24 also presents an upper, horizontal surface 30. A pair of laterally, outwardly-extending flanges 32 are located at the lower end of the upper portion 24. As best shown in FIG. 2, the opposite longitudinal ends 34, 36 of each footer 20 have a portion of increased width 38, 40. The increased width portions 38, 40 mirror one another. As a result, at the first end 34 of the footer 20, the first increased width portion 38 extends laterally outwardly beyond the first side wall 26 but not the second side wall 28. At the second end 36 of the footer 20, the second increased width portion 40 extends laterally outwardly beyond the second side wall 28 but not the first side wall 26.

Figure 6:
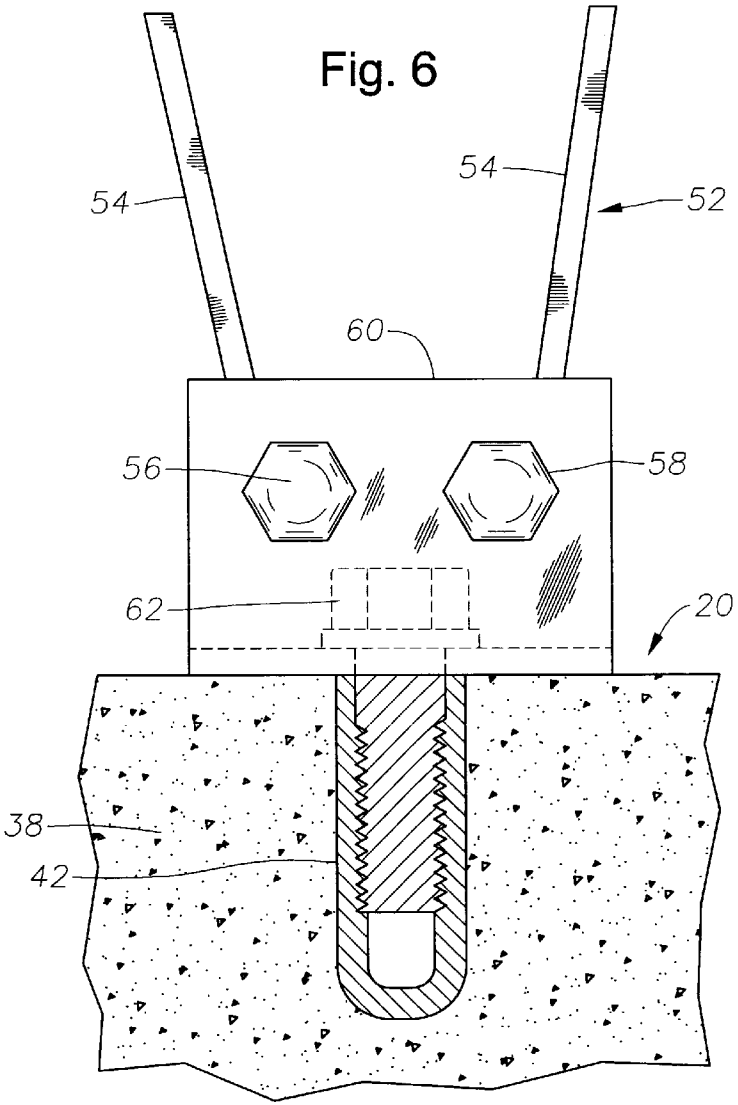
FIGS. 5 and 6 illustrate an exemplary anchoring arrangement used with the present invention.
Figure 5:
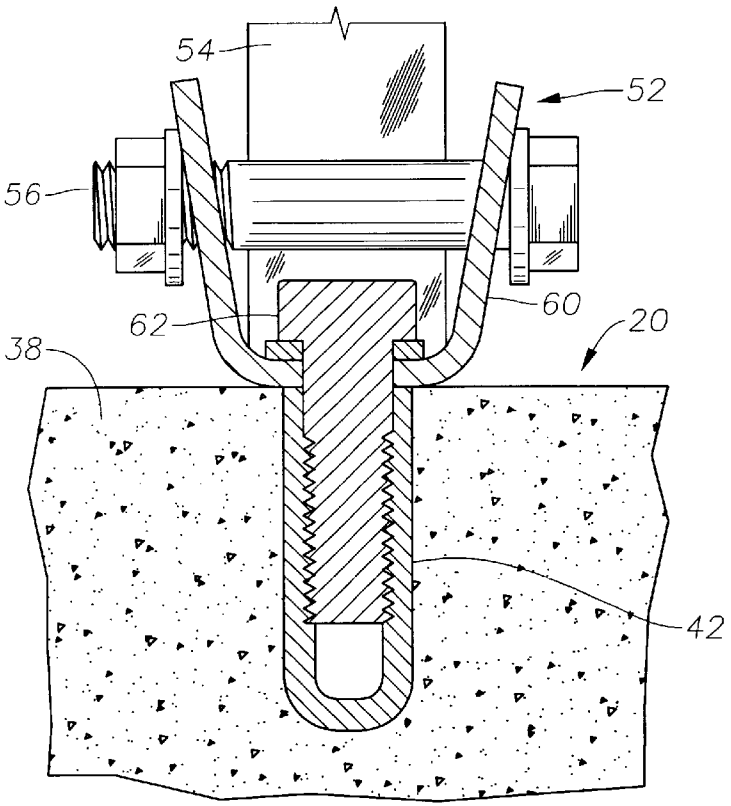

Each of the increased width portions 38, 40 has a bolt anchor shield 42 precast into it, as illustrated in FIG. 3, as well as FIGS. 5 and 6. The anchor shield 42 is an anchorage receptacle that is threaded in its interior and shaped and sized to receive a carriage bolt.

The footer 20 is constructed of concrete and is precast. As FIG. 3 shows, the footer 20 can contain sections of reinforcing steel 44 to increase the ability of the footer 20 to resist failure from tensile or torsional forces. As such techniques are standard in the art, they will not be described in further detail here. It is currently preferred that the footer be approximately 24" in height. The upper portion 24 should be approximately 8" in width from side wall 26 to side wall 28. The flanges 32 should extend approximately 5" outwardly beyond the side walls 26, 28.

The foundation footers 20 are disposed within the area of ground 10 by burying. Parallel trenches 46 are dug in the area, with the spacing between the trenches 46 being equal. At the present time, it is preferred that the trenches 46 be spaced apart from one another at an interval that is no greater than 12 feet o.c. The trenches 46 are constructed using a backhoe or other suitable excavation equipment. After the trenches 46 are dug, their bottom surfaces are leveled out if necessary. If desired, or warranted by soil conditions, a layer of sand 48 may be disposed on the bottom surface of the trench 46.

Once these steps are accomplished, the precast footers 20 are lowered into the trenches 46 and the trenches 46 are backfilled. It is pointed out that the upper surface 30 of each footer 20 must remain exposed and not be buried. The flanges 32 of the footers 20 are covered over during backfilling. The backfilled soil 50 can then be compacted.

The support blocks 22 are placed on the upper surface 30 of each footer 20 at a location wherein they will contact and support a girder 16. An exemplary layout is shown in FIG. 2. The support blocks 22 may comprise 4"×8"×16" concrete block units, of a type known in the art. The manufactured home 12 is then placed atop the blocks 22 so that the girders 16 rest upon the blocks 22. As FIG. 1 depicts, the girders 16 are oriented at an approximate right angle to the footers 20. This right angle orientation helps assure that the foundation for the manufactured home will be stable and differential settlement as between the footers will be resisted by the lateral bracing provided by the girders 16. Shims (not shown) may be placed between selected girders 16 and blocks 22 if needed to level out the home 12.

Figure 4:
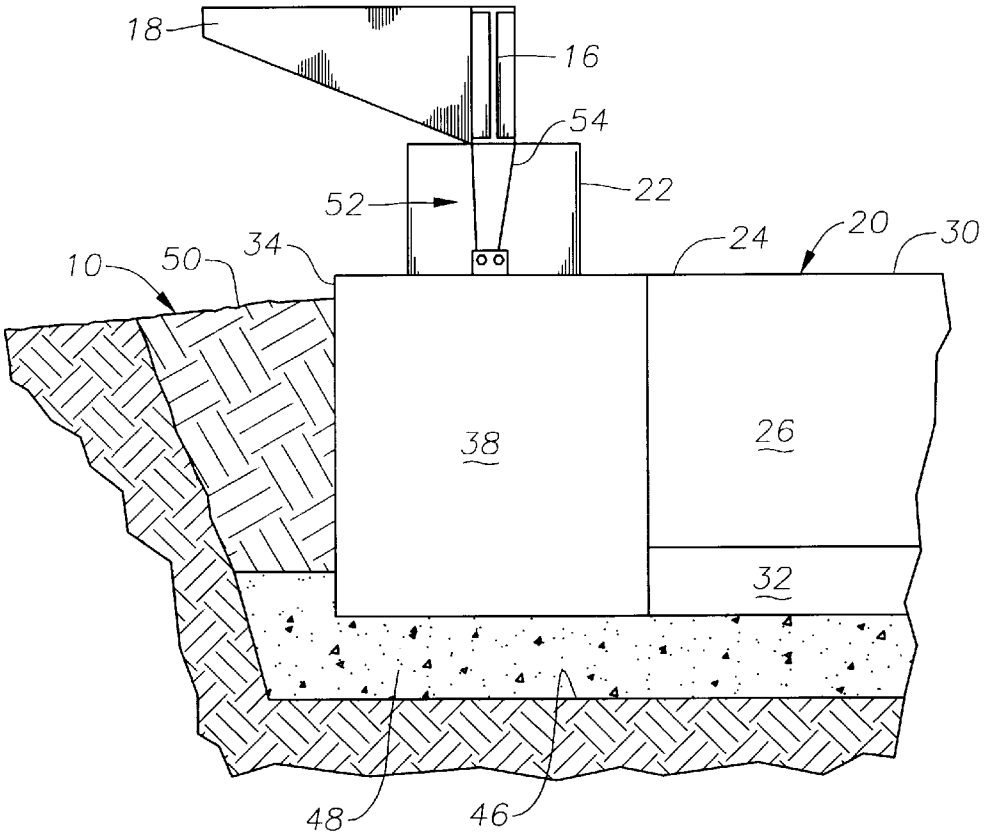
FIG. 4 is a detail view showing attachment of portions of the frame of a manufactured home to a footer.

An anchorage 52 is used to affix the girders 16 to the increased width portions 38, 40 of the footers 20. Details of an exemplary anchorage 52 are shown in FIGS. 4, 5 and 6. FIGS. 5 and 6 provide front and side views of portions of the anchorage 52. The anchorage 52 includes a strong metal collar or strap 54 that is passed around the girder 16 and is affixed at either end to carriage bolt assemblies 56, 58. The carriage bolt assemblies 56,58, in turn, are affixed to bracket 60 that has a downwardly-directed anchoring carriage bolt 62 disposed through it. Anchoring arrangements of this type are known and sold commercially. Rotation of the carriage bolt assemblies 56, 58 will selectively tighten the tension of the strap 54 around the girder 16 thereby ensuring a secure anchoring arrangement. Adjustment of the tension in the anchorage 52 is desirable since the anchorage 52 may be selectively loosened in the event that it becomes necessary to effect repairs of the support frame of the manufactured home. As FIGS. 5 and 6 show, the anchoring carriage bolt 62 can be secured within the anchor shield 42 of the footer 20.

The use of longitudinal, precast footers, such as footers 20, is advantageous as compared to poured-in place footings. Because they are made in advance, use of precast footers avoids the delay associated with curing time for poured-in-place foundation structures. These type of footers are easily transported to a site using a low boy. Additionally, the use of a single footer that provides multiple anchoring points is advantageous since the structure 12 will less prone to damage from differential settlement in the land 10.

While the invention has been described with reference to preferred embodiments it will be apparent to those skilled in the art that it is not limited to that which is described herein. This application is intended to cover any modifications or changes as may come within the scope of the following claims.

What is claimed is:

1. A foundation system for supporting and anchoring a manufactured home to a section of earth, the manufactured home having a support frame with a number of longitudinal girders therein, the system comprising:

a plurality of footers to be disposed within the section of earth, each of the footers having a base and an upper portion with an upper surface, each of the footers having opposite end sections separated by a central section, the upper portion in the central section being of a lesser thickness than the base, defining a T-shaped cross-section, the upper portion in each of the end sections having a greater thickness than the upper portion of the central section; and a plurality of adjustable anchorage mechanisms mounted to the end sections of at least some of the footers to affix at least some of the girders to at least some of the footers.

2. The foundation system of claim 1 further comprising a plurality of separate support blocks positionable upon the upper surfaces of said footers for supporting said girders.

3. The foundation system of claim 1 wherein the upper portion of each of the end sections has a thickness that is less than a width of the base.

4. The foundation system of claim 3 wherein the upper portion of each of the end sections has a vertical wall surface that faces in a longitudinal direction and is flush with a vertical wall of the base.

5. The foundation system of claim 3 wherein the upper portion of one of the end sections has a first vertical wall that faces in a first longitudinal direction and is flush with a first vertical wall of the base, and a second vertical wall that faces in a second longitudinal direction and is offset longitudinally from a second vertical wall of the base; and the upper portion of the other of the end sections has a first vertical wall that faces in the first longitudinal direction and is offset from the first vertical wall of the base, and a second vertical wall that faces in the second longitudinal direction and is flush with the second vertical wall of the base.

6. A method of anchoring a manufactured home to a portion of earth comprising:

(a) excavating a plurality of parallel foundation trenches within said portion of earth, said trenches being in a spaced relation to one another;

(b) forming a plurality of concrete footers, each of the footers having a length approximately equal to a width of the manufactured home, a flange on a lower end and an upper surface located in a single plane, then placing each of the footers in one of said trenches; then (c) placing a plurality of concrete support blocks on the upper surfaces of the footers, the support blocks being spaced apart from each other for supporting lengthwise girders of the manufactured home;

(d) backfilling around each of said footers to cover the flanges and partially bury said footers within the portion of earth;

(e) disposing the manufactured home atop said portion of earth so that the girders of said manufactured home are oriented at approximate right angles to said longitudinal footers and rest on said support blocks; and (e) securing said manufactured home to at least one of said footers by wrapping a strap around at least one of said girders, extending both ends of the strap downward past one of the support blocks, securing the ends of the strap to an anchor mechanism that is mounted to one of the footers, and tightening the anchor mechanism to apply tension to the strap.

7. The method of claim 6 wherein step (e) further comprises placing shims between selected ones of the girders and the support blocks to level the manufactured home.

* * * * *